United States Patent [19]

Jarby

[11] Patent Number: 4,497,141

[45] Date of Patent: Feb. 5, 1985

[54] SMOOTHING, CUTTING AND POLISHING TOOL

[76] Inventor: Sven Jarby, Riethalde, CH-9658 Wildhaus, Switzerland

[21] Appl. No.: 499,565

[22] Filed: May 31, 1983

[51] Int. Cl.[3] ..... B24B 45/00

[52] U.S. Cl. ..... 51/168; 83/666; 403/348

[58] Field of Search ..... 51/168, DIG. 12, 206 R; 83/666, 698; 433/125, 134; 403/254, 348, 4

[56] References Cited

U.S. PATENT DOCUMENTS

| | | | |
|---|---|---|---|
| 505,490 | 9/1893 | Stanbrough | 433/134 |
| 1,307,017 | 6/1919 | Movshovitch | 433/134 |
| 1,907,319 | 5/1933 | Engelfried | 51/DIG. 12 |

OTHER PUBLICATIONS

Dental-Dienst, No. 2/81, pp. 18–26.
Tandelaegebladet, vol. 1980:84: No. 13:5379.

*Primary Examiner*—Roscoe V. Parker
*Attorney, Agent, or Firm*—Benoit Law Corporation

[57] ABSTRACT

Apparatus for smoothing, cutting, grinding and polishing with a disc, comprise a disc drive having a head including a disc retainer member insertable for formfitting interlock into an oblong central hole of the disc. The head is undercut by grooves cooperating with the disc and delimiting means forming a bayonet-type interlock for rotation in a first sense as well as for rotation in an opposite second sense.

20 Claims, 3 Drawing Figures

SMOOTHING, CUTTING AND POLISHING TOOL

BACKGROUND OF THE INVENTION

The subject invention relates to a smoothing, cutting and polishing tool for use in the field of denistry, for work by dental technicians, in jewelry making, in tool manufacture and in various other fields and applications.

Tools of this type typically have a smoothing, grinding, cutting and polishing disc attached thereto. Particularly in the field of dentistry, devices for carrying such discs are often referred to as mandrels, and serve to provide a rigid mounting device for smoothing discs made of grinding cloth, felt, rubber, leather or synthetic materials. In the publication *Dental-Dienst,* No. 2/81, p.p. 18–26, an assortment of such smoothing discs and disc-carrying devices is presented, but the various embodiments distinguish themselves from each other essentially only by the manner in which the discs are mounted.

According to a first form, the disc-carrying device is axially bored and provided with an internal thread. The disc is fastened to the top of the disc-carrying device by means of a washer and a screw. In addition the cited publication points out that, "A well tightened screw as well as a flawless handle to which a carrier is fastened up to the top guarantee a long functional lifetime and safe working conditions." In polishing and smoothing procedures in dental offices and dental laboratories such devices are used with a rate of up to 85 000 rpm.

It is known that for dental work these devices are designed for rotation in both directions. Accordingly, in order to avoid the loosening of the threaded connection at revolutions, their internal threads and screws are provided with both a right handed and left handed version.

Such a fastening process is time consuming and requires the screw to be driven in, in order to provide for a secure tightening thereof.

For a separating disc quick mount, particularly for discs made of paper or nylon, a disc-carrying device bored in an axial direction has been proposed, equipped with points and at a free end of the head, with a clamp holder consisting of a plate for the purpose of pressing on a disc and a multiply bent shaft, maintaining itself by virtue of the resiliency due to the bending in the boring of the disc carrier. For this fastening type, use of the tool at the usual high revolutions, but with only slight lateral pressure, is recommended.

A similar fastening mode is effected by means of a head with an axial slit and a wedge shaped insert. Those two forms require substantial skill by the dentist, since the discs could break under the required contact pressure. In addition it is known that this carries a danger of possible injury to the dentist, particularly to his or her fingers.

The holes in the discs are frequently reinforced by eylets of square or round opening. This raises difficulties in the manufacturing process, since the high number of revolutions requires a precise centering of the eyelets. Furthermore, unvoidable mostly dark discolorations occur in the areas touched by such metallic core during the process of smoothing or polishing of fillings or surfaces of a tooth.

Since the flying off of a disc could be lethal to a patient, a good fastening device is imperative as demonstrated in an article in "*Tandelaegebladet,*" Vol. 1980:84:No. 13:5379.

SUMMARY OF THE INVENTION

It is a general object of this invention to overcome the disadvantages and to meet the needs expressed or implicit in the above mentioned text.

It is a germane object of this invention to provide improved methods and apparatus for mounting and operating a disc as a rotary tool.

It is a related object of this invention to provide an improved smoothing, cutting and polishing tool wherein the disc can be fastened without exercise of great skill and is held in place safely, irrespective of the direction of rotation.

It is a further related object of this invention to provide improved smoothing, cutting and polishing discs for use in or on smoothing, cutting and polishing appara- tus.

Other objects of the invention will become apparent in the further course of this disclosure.

The subject invention resides in methods and apparatus for mounting and operating a disc as a rotary tool on a disc drive subject to rotation in a first sense and alternatively in an opposite second sense of rotation, comprising, in combination, the steps of, or means for, providing a disc supporting surface on the disc drive, and releasably retaining the disc on the disc supporting surface in a first force-transmitting relationship with the disc drive for the first sense of rotation, but providing play between the releasably retained disc and the disc drive for movement of the disc into an alternate second force-transmitting relationship upon reversal of the disc drive to said second sense of rotation.

From another aspect thereof, the subject invention resides in apparatus for smoothing, cutting and polishing with a disc, comprising a disc drive having a head including a disc retainer member insertable for formfitting interlock into an oblong central hole of the disc and being undercut by grooves cooperating with the disc and delimiting means forming a bayonet-type interlock for rotation in a first sense as well as for rotation in an opposite second sense.

From a further aspect thereof, the subject invention resides in apparatus for smoothing, cutting and polishing with a disc mountable on a disc drive having a head including an oblong disc retainer member undercut by grooves having bases defining a parallelogram, comprising a smoothing, cutting and polishing disc having an oblong central hole corresponding to a periphery of the oblong retainer member and adapted for formfitting interlock with the retainer member and selectively with a first set of two opposite ones of said bases and alternatively with a second set of another two opposite ones of the bases upon a reversal of rotation of the disc drive.

No limitation to any object, aspect, method, apparatus, combination, step, element or feature is intended by any part of the subject summary of the invention, and no admission of any prior art or similar limitation is intended by any preamble of any Jepson-type or other claims. For instance, a particular Jepson-type claim herein provided has the purpose of providing separate and independent protection for the claimed disc, and does not imply that any disc drive recited in its preamble forms part of the prior art or would be obvious therefrom.

BRIEF DESCRIPTION OF THE DRAWINGS

The invention will become more readily apparent from the following detailed description thereof, illustrated by way or example in the accompanying drawings, in which.

DESCRIPTION OF PREFERRED EMBODIMENT

Figure 1:
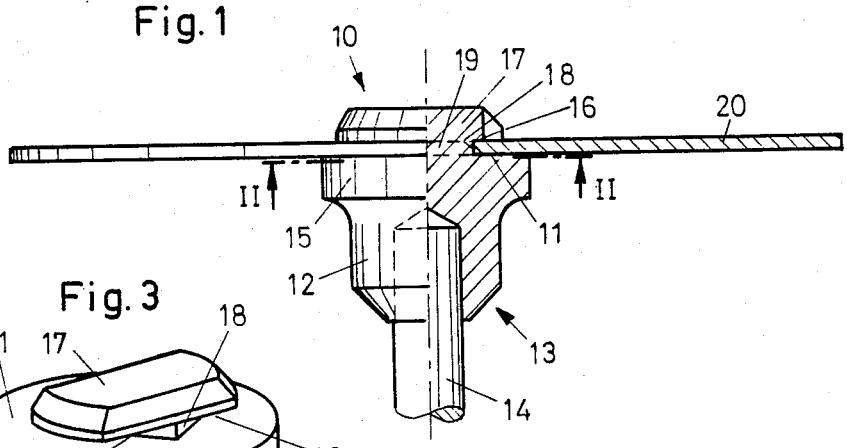
FIG. 1 is a side view, partially in section, of a smoothing, cutting and polishing tool according to a preferred embodiment of the invention, as seen along the line I—I in FIG. 2.
Figure 3:
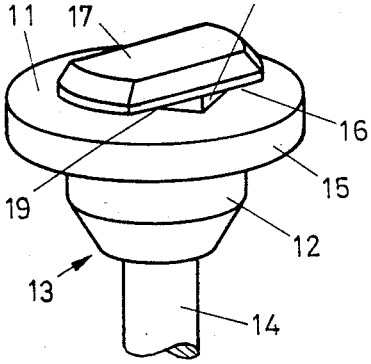
FIG. 3 is a perspective view of the head of the disc-carrying device shown in FIGS. 1 and 2.
Figure 2:
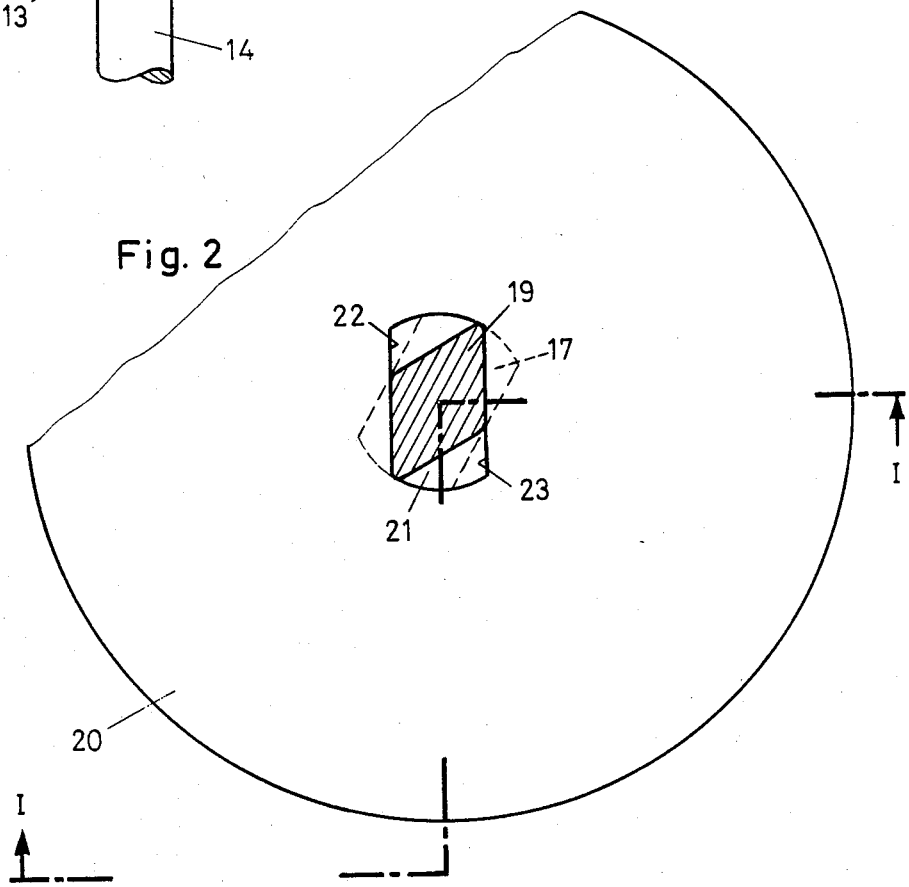
FIG. 2 is a view taken on the line II—II in FIG. 1.

The disc-carrying device 10 according to the illustrated preferred embodiment of the invention carries a disc 20 as shown in FIGS. 1 and 2. A disc supporting surface 11 is formed on a head 12 of the disc-carrying device 10. The head 12 has a hub part 13 in the form of a socket slippable onto or attached to the shaft 14 of a handpiece or similar rotating device. The head further comprises a carrying disc 15 forming the disc supporting surface, and a disc retainer 17 spaced by straight grooves 16 from the surface 11 or carrying disc 15. As best seen in FIGS. 2 and 3, the grooves 16 delimit or form a spacer member 19 with a cross-section in the shape of a parallelogram or rhomboid.

The longer rectangular sides of the disc retainer 17 preferably are parallel to the longer diagonal of the rhomboid spacer member 19 in such a way that the grooves 16 extend from the middle of one side to the middle of the other side of the disc retainer.

The disc 20 has a central hole 21 of a circumference or periphery having the same shape and dimensions as the disc retainer 17. Thus the disc retainer 17 can be inserted in formfitting relationship into the hole 21.

With this arrangement of the illustrated preferred embodiment of the invention, a simple twisting motion of the disc-carrying device 10 and the disc 20 relative to each other is sufficient to assure retention of the disc 20 in the grooves 16 between the plane supporting surface 11 of the carrying disc 15 and the disc retainer 17. Due to the straightly executed grooves 16, the longer side edges 22 and 23 of the oblong hole 21 of the disc 20 join themselves with the bases 18 of the grooves 16 and thus rotate without play with the disc-carrying device 10.

Since the sides edges 22 and 23 are supported by more than half of their length on two sides of the spacer member 19, the pressure on spacer member and disc is distributed over a longer part of the edge than in the prior art that made use of a square hole. In consequence, it is no longer necessary to reinforce the edges by means of metal eylets that could cause discolorations when coming in contact with fillings or tooth surfaces.

The head 12 can easily be manufactured from synthetic material by die casting or an injection or other molding process. This eliminates any danger of injuries in the mouth of the patient from hard metal edges, as was the case with prior art screw or socket devices.

A further important advantage is the very simple mounting procedure according to the subject invention. All that is necessary is that the disc retainer 17 be pushed through the hole 21 in the disc 20 and the disc then be slightly twisted. Alternatively, the disc 20 may be slipped at its hole 21 over the retainer 17 and then twisted. In either case, the dentist is no longer required to handle any screw, such as typically a screw of about 1 cm length and only 1.5 mm in diameter, and thereby also select the thread direction of disc-carrying device and screw.

Even during sudden reversals of the direction of rotation of the shaft 14 the disc 20 cannot come loose and thus cause damage and injury. Rather, as indicated in FIG. 2 by means of a broken outline, the disc has two stable positions and turns from one position to the other without coming off the device 10.

Although the illustrated embodiment is shown with an axisymmetrical head, the scope of the invention is not so limited, but extends to other configurations can be used for both the disc retainer 17 and the hole 21, as long as the two shapes are formfitting or may be placed over or through each other and at least one straight segment or edge, which can be placed adjacent or joined to a straight base of grooves extending angularly to each other, are present, so as to assure a rotation-proof mounting of the disc.

Although the subject disclosure has been styled mostly in terms of structure, the subject invention resides also in a method of counting and operating a disc 20 as a rotary tool on a disc-carrying device or disc drive 10, which is subject to rotation in a first sense and alternatively in an opposite second sense of rotation. This method provides, and the resulting apparatus has, a disc-supporting surface 11 on the disc drive. Moreover, this method and its corresponding apparatus releasably retain the disc 20 on the disc-supporting surface 11 in a first force-transmitting relationship with the disc drive 10 for the first sense of rotation, but provide play between the releasably retained disc 20 and the disc drive for movement of the disc into an alternate second force-transmitting relationship upon reversal of the disc drive to the second sense of rotation. In FIG. 2, such play is visible in the central hole 21 of the disc between its straight edges 22 and 23 on the one hand and the spacer member 19 on the other hand.

During operation of the tool, the disc is moved into its alternate second force-transmitting relationship upon the reversal of the disc drive, and play is then provided between the latter moved disc and the disc drive for movement of such disc 20 back into the first force-transmitting relationship upon reversal of the disc drive back to the first sense of rotation.

Part of such further play may be seen in FIG. 2 within outer portions of the dotted outline at 17, but such play will, of course, increase to the same magnitude as the play shown at 22 and 23, as the disc angularly moves to its alternative position upon reversal of the sense of rotation of the disc drive.

Contrary to the prior-art approach of filling the central hole in polishing and cutting discs with an arbor, the subject invention thus provides the disc with a central hole 21 providing the mentioned play between the disc and one or more adjacent portions of the disc drive at 19. As already indicated, such play may be provided as a first play between a first region of the disc and a first portion of the disc drive and as a second play between a second region of the disc and a second portion of the disc drive, so as to cover both alternative forward and reverse rotations of the disc. The disc may thus be provided with a central hole 21 extending to the first region and extending to the second region, just mentioned, of the disc 20.

According to the illustrated embodiment of the subject invention, the disc is provided with a central hole 21 having a first side edge 22 defining the mentioned play between the disc and a straight first region of the disc drive at 19. The disc 20 is thereupon placed onto the disc drive at an angular position corresponding to a fraction of the mentioned play. In this respect, the dotted outline at 17 in FIG. 2, while showing primarily an outline of the retainer member 17, shows also the angular position of the hole 21 when the disc is inserted over the retainer 17 onto the supporting surface 11, or when such retainer member 17 is inserted through the aperture 21 of the disc.

As apparent from the drawings, the disc 20 is provided with a central hole 21 having a first side edge 22 defining the mentioned play between the disc and a straight first region of the disc drive at 19. Again, the disc 20 is placed onto the disc drive at an angular position corresponding to one half of the play, as apparent at the dotted outline 17 on FIG. 2. Preferably, the central hole 21 is provided with a second side edge 23 at the disc 20 defining such play also between the disc and a straight second region of the disc drive, such as seen at the end of the reference line of the numeral 21 in FIG. 2.

According to the illustrated preferred embodiment of the subject invention, the disc 20 is provided with a central hole 21 having two spaced parallel straight edges 22 and 23. The disc drive is further provided with a central rhomboid member 19 projecting from the disc-supporting surface 11. The rhomboid member 19 is disposed with a first set of opposite straight edges thereof into force-transmitting relationship with the parallel straight edges 22 and 23 of the disc, as shown in dotted lines in FIG. 2. This leaves the desired play between the second set of opposite straight edges of the rhomboid member and the parallel straight edges 22 and 23 of the disc.

Upon reversal of rotation of the disc drive 10, play is thus provided between the mentioned first set of opposite straight edges of the rhomboid member 19 and the parallel straight edges 22 and 23 of the disc, and the mentioned second set of opposite straight edges of the rhomboid member 19 is disposed into force-transmitting relationship with the parallel straight edges 22 and 23 of the disc.

The disc 20 is releasably retained on the disc drive supporting surface with a retainer 17 having a shape corresponding to the central hole 21 in the disc and located on the rhomboid member 19.

Apparatus for smoothing, cutting and polishing with a disc, comprise according to a preferred embodiment of the subject invention, a disc drive 10 having a head 12 including a disc retainer member 17 insertable for formfitting interlock into an oblong central hole 21 of the disc and being undercut by grooves 16 cooperating with the disc 20 and delimiting means forming a bayonet-type interlock for rotation in a first sense, as illustrated in FIG. 2, as well as for rotation in an opposite second sense, as described above. Perimeters of the retainer member 17 and the oblong hole 21 in the disc include corresponding straight portions determining a relative angular position of retainer member 17 and disc 20 at which the retainer member is insertable into the hole 21 in the disc or, in other words, at which the disc 20 is insertable over the retainer member 17.

The plane supporting surface 11 for the disc 20 is preferably constituted by an extension of a wall of the grooves 16 opposite the retainer member 17.

A perimeter of the retainer member 17 and a perimeter of the oblong hole 21 in the disc each have two straight portions as seen at 22 and 23 for the disc 20 and at the straight portions of the dotted outline 17 for the retainer indicated in FIG. 2. Bases 18 of the grooves define a parallelogram, as seen at 19, corresponding to the straight portions just mentioned.

While smoothing, cutting and polishing have been emphasized herein, the apparatus or disc 20 may be used for grinding, honing and all kinds of other operations.

The discs may be manufactured, distributed and sold separately from the disc drive 10, and separate and independent protection for the disc is thus sought herein.

In particular, a smoothing, cutting and polishing disc according to the currently discussed aspect of the subject invention has an oblong central hole 21 corresponding to a periphery of the oblong retainer member 17 and being adapted for formfitting interlock with the retainer member 17 and selectively with a first set of two opposite ones of the bases 18 and alternatively with a second set of another two other opposite ones of the bases of the grooves 16 at the rhomboid member 19 upon a reversal of rotation of the disc drive. The oblong hole in the disc according to the illustrated embodiment of the invention has two spaced parallel straight edges 21 and 23. In the illustrated embodiment, the oblong hole 21 of the disc 20 also has two spaced curved edges, each extending between the two spaced parallel straight edges 22 and 23, as shown in FIG. 2.

The subject extensive disclosure will suggest or render apparent to those skilled in the art various modifications and variations within the spirit and scope of the subject invention and embodiments or equivalents thereof.

I claim:

1. A method of mounting and operating a disc as a rotary tool on a disc drive subject to rotation in a first sense and alternatively in an opposite second sense of rotation, comprising in combination the steps of:

providing a disc supporting surface on the disc drive; and releasably retaining the disc on the disc supporting surface in a first force-transmitting relationship with the disc drive for said first sense of rotation, but providing play between said releasably retained disc and the disc drive for movement of the disc into an alternate second force-transmitting relationship upon reversal of the disc drive to said second sense of rotation.

2. A method as claimed in claim 1, including the steps of:

moving the disc into said alternate second force-transmitting relationship upon said reversal of the disc drive; and providing play between the latter moved disc and the disc drive for movement of the disc back into said first force-transmitting relationship upon reversal of the disc drive back to said first sense of rotation.

3. A method as claimed in claim 1, including the step of:

providing the disc with a central hole providing said play between the disc and an adjacent portion of the disc drive.

4. A method as claimed in claim 1, including the step of:

providing said play as a first play between a first region of the disc and a first portion of the disc drive and as a second play between a second region of the disc and a second portion of the disc drive.

5. A method as claimed in claim 4, wherein:

the disc is provided with a central hole extending to said first region and extending to said second region of the disc.

6. A method as claimed in claim 1, including the step of:

providing the disc with a central hole having a first side edge defining said play between the disc and a straight first region of the disc drive; and placing the disc onto the disc drive at an angular position corresponding to a fraction of said play.

7. A method as claimed in claim 1, including the step of:

providing the disc with a central hole having a first side edge defining said play between the disc and a straight first region of the disc drive; and placing the disc onto the disc drive at an angular position corresponding to one half of said play.

8. A method as claimed in claim 6, including the step of:

providing the central hole with a second side edge at the disc defining said play also between the disc and a straight second region of the disc drive.

9. A method as claimed in claim 1, including the steps of:

providing the disc with a central hole having two spaced parallel straight edges;

providing the disc drive with a central rhomboid member projecting from the disc supporting surface;

disposing the rhomboid member with a first set of opposite straight edges thereof into force-transmitting relationship with said parallel straight edges of the disc; and leaving play between a second set of opposite straight edges of the rhomboid member and said parallel straight edges of the disc.

10. A method as claimed in claim 9, including the step of:

providing play between said first set of opposite straight edges of the rhomboid member and the parallel straight edges of the disc upon reversal of rotation of the disc drive; and disposing the second set of opposite straight edges of the rhomboid member into force-transmitting relationship with the parallel straight edges of the disc.

11. A method as claimed in claim 9, including the step of:

releasably retaining the disc on the disc supporting surface with a retainer having a shape corresponding to said central hole in the disc and located on the rhomboid member.

12. Apparatus for mounting and operating a disc as a rotary tool on a disc drive subject to rotation in a first sense and alternatively in an opposite second sense of rotation, comprising in combination:

a disc supporting surface on the disc drive; and means for releasably retaining the disc on the disc supporting surface in a first force-transmitting relationship with the disc drive for said first sense of rotation, including means for providing play between said releasably retained disc and the disc drive for movement of the disc into an alternate second force-transmitting relationship upon reversal of the disc drive to said second sense of rotation.

13. Apparatus as claimed in claim 12, including:

means for providing play between the disc and the disc drive for movement of the disc back into said first force-transmitting relationship upon reversal of the disc drive back to said first sense of rotation.

14. Apparatus for smoothing, cutting and polishing with a disc, comprising:

a disc drive having a head including a disc retainer member insertable for formfitting interlock into an oblong central hole of the disc and being undercut by grooves cooperating with the disc and delimiting means forming a bayonet-type interlock for rotation in a first sense as well as for rotation in an opposite second sense.

15. Apparatus as claimed in claim 14, wherein:

perimeters of said retainer member and said oblong hole in the disc include corresponding straight portions determining a relative angular position of retainer member and disc at which the retainer member is insertable into the hole in the disc.

16. Apparatus as claimed in claim 14, including:

a plane supporting surface for said disc constituted by extension of a wall of said grooves opposite said retainer member.

17. Apparatus as claimed in claim 14, wherein:

a perimeter of said retainer member and a perimeter of said oblong hole in the disc each have two straight portions, and bases of said grooves define a parallelogram having sides corresponding to said straight portions.

18. Apparatus for smoothing, cutting and polishing with a disc mountable on a disc drive having a head including an oblong disc retainer member undercut by grooves having bases defining a parallelogram, comprising:

a smoothing, cutting and polishing disc having an oblong central hole corresponding to a periphery of said oblong retainer member and adapted for formfitting interlock with said retainer member and selectively with a first set of two opposite ones of said bases and alternatively with a second set of another two opposite ones of said bases upon a reversal of rotation of said disc drive.

19. Apparatus as claimed in claim 18, wherein:

said oblong hole in the disc has two spaced parallel straight edges.

20. Apparatus as claimed in claim 19, wherein:

said oblong hole has two spaced curved edges each extending between said two spaced parallel straight edges.

* * * * *